US006860576B2

(12) United States Patent
Kawasaki et al.

(10) Patent No.: US 6,860,576 B2
(45) Date of Patent: Mar. 1, 2005

(54) DRIVE CIRCUIT, PRINTHEAD AND PRINTING APPARATUS

(75) Inventors: Somei Kawasaki, Saitama (JP); Hiroyuki Maru, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/462,640

(22) Filed: Jun. 17, 2003

(65) Prior Publication Data

US 2004/0004647 A1 Jan. 8, 2004

(30) Foreign Application Priority Data

Jun. 19, 2002 (JP) ..... 2002-178830

(51) Int. Cl.[7] ..... B41J 29/38; B41J 2/36
(52) U.S. Cl. ..... 347/14; 347/192
(58) Field of Search ..... 347/14, 192, 209

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 5,602,576 | A | 2/1997 | Murooka et al. | 347/59 |
| 5,731,828 | A | 3/1998 | Ishinaga et al. | 347/62 |
| 6,054,689 | A | 4/2000 | Imanaka et al. | 219/501 |
| 6,116,714 | A | 9/2000 | Imanaka et al. | 347/19 |
| 6,224,195 | B1 | 5/2001 | Maru et al. | 347/60 |
| 6,471,324 | B1 | 10/2002 | Maru | 347/19 |
| 2003/0151636 | A1 * | 8/2003 | Masumoto | 347/9 |
| 2004/0036723 | A1 * | 2/2004 | Eguchi et al. | 347/9 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Stephen D. Meier
*Assistant Examiner*—Alfred E. Dudding
(74) *Attorney, Agent, or Firm*—Fitzpatrick, Cella, Harper & Scinto

(57) ABSTRACT

Power consumed by a resistor connected between a first power supply and a drive control circuit is controlled by a power driving circuit connected to a second power supply. When the value of current that flows into the resistor fluctuates, the value of current output from power driving circuit to a control terminal of the drive control circuit is controlled in such a manner that power consumed is the same as that when the resistance value of the resistor is a set value. As a result, the value of power consumed by the resistor is rendered substantially constant without being influenced by a variation in the resistance value of the driven resistor or by the power supply voltage. If such a drive circuit is used in driving the printhead of a printing apparatus, stabilized drive can be achieved with the minimum margin, power consumption can be suppressed and the lifetime of the printhead can be prolonged.

6 Claims, 14 Drawing Sheets

DRIVE CIRCUIT, PRINTHEAD AND PRINTING APPARATUS

FIELD OF THE INVENTION

This invention relates to a drive circuit, a printhead and a printing apparatus. More particularly, the invention relates to the drive circuit of a printhead for controlling the value of power consumed by a driven resistor without being affected by a variation in the resistance value of the resistor or by power supply voltage.

BACKGROUND OF THE INVENTION

A drive circuit for producing thermal energy by passing a current through a resistor finds use in various equipment and devices. An ink-jet printer is a typical example of such a device. An ink-jet printer of this type has heaters constituted by resistors provided within a printhead and prints an image on a printing medium by utilizing thermal energy, which is produced by passing a current through the heaters, to forcibly eject ink onto the medium from nozzles.

FIG. 11 is a circuit diagram illustrating the general features of a drive circuit for driving a printhead used in an ink-jet printer.

As shown in FIG. 11, one end of each of heaters RHa to RHx constituted by resistors is connected to a first power supply VCC via a power supply wiring resistor rx2. The other ends of the heaters RHa to RHx are connected to the drain terminals of drive transistors M34*a* to M34*x*, respectively. The source terminals of the transistors are connected to a power supply GND via a power supply wiring resistor rx3, and drive control signals Fa to Fx are input to the gate terminals of respective ones of these transistors.

By way of example, if the drive control signal Fa attains the H (high) level, transistor M34*a* turns on and heater RHa becomes a path of current between the power supplies VCC and GND. A current therefore flows into the heater RHa, which produces thermal energy in accordance with the power consumed by the heater. A similar operation will be performed if drive control signals corresponding to the other heaters RHb to RHx, respectively, attain the high level.

The overall printhead has, e.g., 512 heaters corresponding to the nozzles. The heaters are divided into 16 blocks of 32 nozzles each, and the blocks are driven in time-shared fashion as the printhead is moved (i.e., made to scan across the printing medium), thereby achieving a printing scan.

In the circuit for driving the printhead of an ink-jet printer having such a construction, there are cases where, depending upon the image printed, all 32 heaters within the same block are driven simultaneously. In such case, if the ON resistances of the transistors M34*a* to M34*x* are sufficiently small and the values of the wiring resistors rx2 to rx3 are made sufficiently small in comparison with the resistance values of the heaters RHa to RHx, then the theoretical value of power Pc consumed by each of the heaters RHa to RHx will be as indicated by the following equation:

$$Pc=(VCC-VEE)^2\div RH\times k \quad (1)$$

where k represents a coefficient indicating ON time ratio of the transistors M34*a* to M34*x* turned on by the drive control signals Fa to Fx, respectively. By controlling the pulse width of the drive control signals Fa to Fx, therefore, the power consumed by each of the heaters RHa to RHx can be made a desired value.

In order to perform the ink ejection operation accurately in the above-described circuit for driving the printhead of an ink-jet printer, it is necessary to drive the head in such a manner that the amount of heat produced by each heater will exceed a predetermined threshold value.

However, when the amount of heat produced by power consumption in each heater is set so as to sufficiently exceed the amount of heat necessary for ejecting the ink, part of a heater and its surroundings (nozzle) will attain a high temperature if the resistance value of the heater varies. The result is a shorter printhead lifetime.

In order to prevent the above, it is necessary to control properly the power consumed by the heater and to design the circuitry in such a manner that the resistance values of the heaters RHa to RHx will be as uniform as possible.

With the conventional circuitry for driving a printhead, however, the following problem arises: The drive circuit that includes the heater RH is formed on a silicon chip. Consequently, the resistance value of the heater RH exhibits a variation of about ±20% and the consumed power indicated by Equation (1) develops a variation of about 40%. For this reason, the heaters RH are ranked according to range of resistance values and control is performed in such a manner that the input duration (pulse width) of a drive control signal F will take on a length that conforms to each rank. If this approach is adopted, there is not only a decline in printhead productivity but also greater difficulty in terms of control. The overall cost of the apparatus rises as well.

In each rank also there is a variation on the order of ±2% with regard to the resistance value of the heater RH. No measures whatsoever are provided for dealing with this, and some leeway is left when making the settings so that the power consumed by each heater will exceed a predetermined value. This makes it difficult to extend the life of the printhead.

The drive transistors M34*a* to M34*x* are designed so as to have a very large gate width in order to reduce the ON resistance. This increases the size of the silicon chip on which the drive circuit is mounted is large and raises cost.

In order to reduce the size of the drive transistors M34*a* to M34*x*, a special and costly D (double diffusion) MOS process must be adopted. In this case also, however, control based upon Equation (1) above cannot be applied to the transistors M34*a* to M34*x*. The reason for this is that the current driving performance of the MOS transistors M34*a* to M34*x* declines with a rise in temperature, i.e., the ON resistance values fluctuate at the operating temperature. As a consequence, some leeway is left when making the settings so that the power consumed by each heater will exceed a predetermined value. This makes it difficult to extend the life of the printhead.

The total value of the currents that flow through the heaters RHa to RHx varies depending upon the image printed and is not constant at all times. In other words, the value of the current that flows through the power supply wiring resistors rx3 and rx4 is not constant and therefore the power consumed by each heater does not take on the value indicated by Equation (1). Consequently, some leeway is left when making the settings so that the power consumed by each heater will exceed a predetermined value. This makes it difficult to extend the life of the printhead.

Furthermore, in order to reduce the values of the power supply wiring resistors rx2, rx3, it is necessary to take into consideration the power supply wiring on the silicon chip on which the drive circuit is mounted and the wiring from the external power supply.

As indicated by Equation (1) above, the power consumed by the heaters is influenced by the power supply voltage. Accordingly, it is necessary to stabilize the value of the external power supply voltage (VCC–VEE). The result is a power supply of higher cost and larger size.

SUMMARY OF THE INVENTION

Accordingly, an object of the present invention is to provide a drive circuit that makes it possible to control the value of power consumed by a driven resistor without being influenced by a variation in the resistance value of the resistor or by the power supply voltage.

Another object of the present invention is to provide a printhead having a drive circuit that makes it possible to control the value of power consumed by a driven resistor without being influenced by a variation in the resistance value of the resistor or by the power supply voltage.

A further object of the present invention is to provide a printing apparatus that uses a printhead having a drive circuit that makes it possible to control the value of power consumed by a driven resistor without being influenced by a variation in the resistance value of the resistor or by the power supply voltage.

According to the present invention, the foregoing objects are attained by providing a drive circuit comprising: a resistor having one end thereof connected to a first power supply; drive control means, which is connected to the other end of the resistor, for controlling drive of the resistor, the drive control means having a control terminal; and a power driving circuit, which is connected to a second power supply, for controlling power consumed by the resistor based upon a value of current supplied to the control terminal of the drive control means; the power driving circuit including: a first voltage-to-current converting circuit, to which are input (a) a first voltage value corresponding to voltage across both ends of the resistor prevailing when power consumed by the resistor has attained a predetermined value at such time that the resistance value of the resistor is a set value, (b) a second voltage value corresponding to voltage across both ends of the resistor prevailing when power consumed by the resistor becomes substantially equal to the predetermined value at such time that the resistance value of the resistor fluctuates from the set value, and (c) a current value corresponding to current that flows through the resistor, for controlling an output current value by a control signal that corresponds to a value of voltage across both ends of the resistor; and a second voltage-to-current converting circuit for controlling an output current value based upon the control signal, having a voltage-to-current converting characteristic similar to that of the first voltage-to-current converting circuit, and outputting a current to the control terminal of the drive control means.

Further, the above and other objects are attained by providing a printhead having the above-described drive circuit and a printing apparatus that uses the above-described printhead.

Thus, according to the present invention, when the value of a current that flows through a resistor fluctuates, the value of current that is output from a power driving circuit to a control terminal of drive control means is controlled in such a manner that power consumed is the same as that when the resistance value of the resistor is a set value.

If this expedient is adopted, control can be carried out in such a manner that the value of power consumed by a resistor is rendered substantially constant without being influenced by a variation in the resistance value of the resistor or by the power supply voltage.

Accordingly, if such a drive circuit is used in driving the printhead of a printing apparatus, stabilized drive can be achieved with the minimum margin, power consumption can be suppressed and the lifetime of the printhead can be prolonged.

Furthermore, the present invention solves the problems encountered in the design of the drive circuit of a printhead, namely the variation in the absolute values of the resistance values of resistors, a relative variation in these values, the problem ascribable to the power supply wiring resistance and the problem relating to stabilization of the supply voltage. This makes it possible to reduce the design and structure of the printhead.

Preferably, the drive control means includes a current mirror circuit.

A plurality of the resistors may be provided and a plurality of the power driving circuits may be provided for every prescribed number of the resistors.

The circuit can be fabricated on an element substrate by a semiconductor manufacturing process.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

An "substrate" (to be also referred to as an "element board" hereinafter) includes not only a base plate made of a silicon semiconductor but also a base plate bearing elements and wiring lines.

The following expression "on an substrate" means "the surface of an substrate" or "the inside of an substrate near its surface" in addition to "on an substrate". "Built-in" in the present invention does not represent a simple layout of separate elements on a base, but represents integral formation/manufacture of elements on an substrate by a semiconductor circuit manufacturing process.

First, a typical structure and control construction of a printing apparatus using a printing head according to the present invention will be described.

<Brief Description of a Printing Apparatus>

Figure 12:
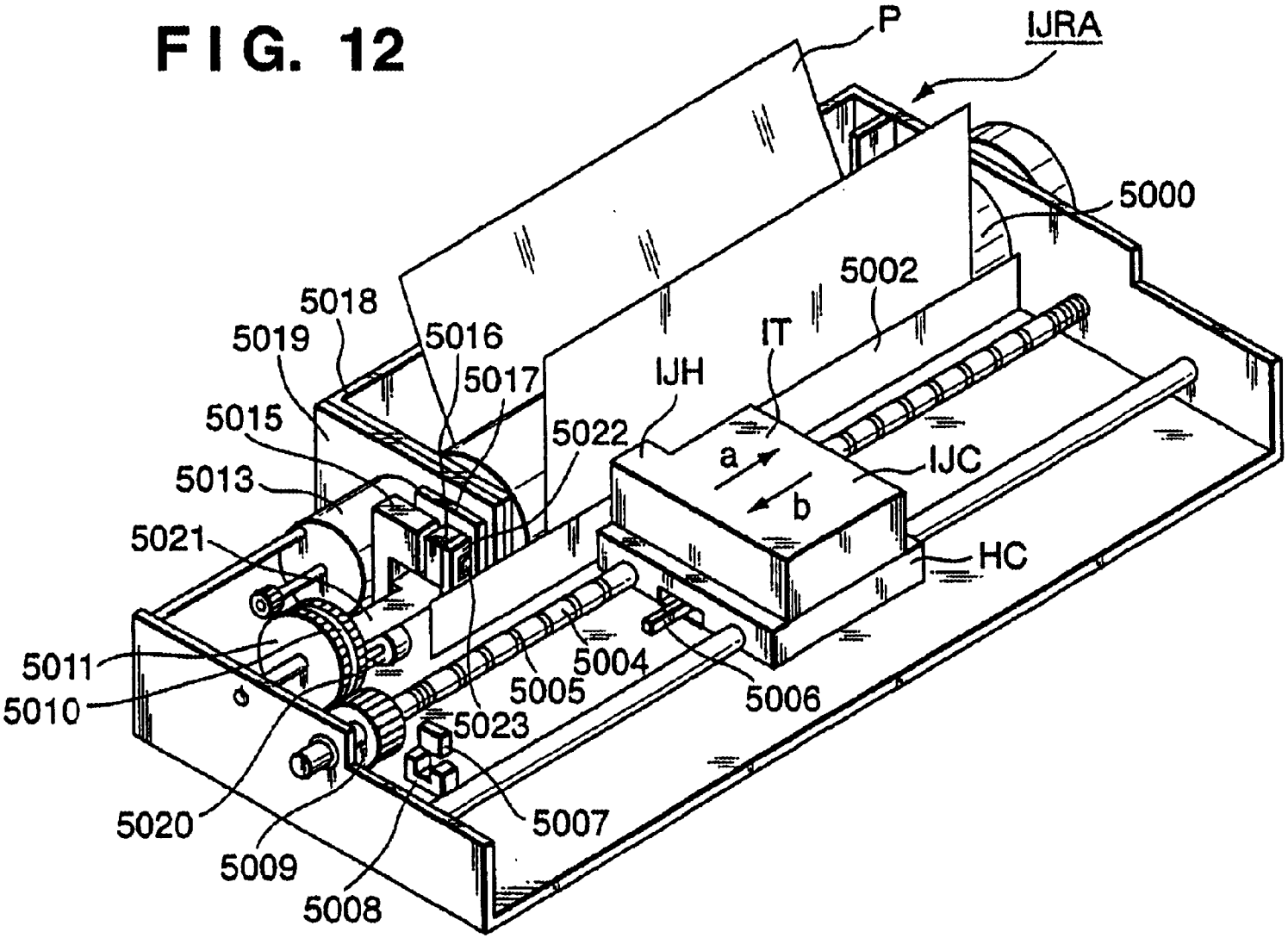
FIG. 12 is a perspective view showing an outer appearance of the construction of a printing apparatus.

FIG. 12 is a perspective view showing the outer appearance of an ink-jet printer IJRA as a typical embodiment of the present invention. Referring to FIG. 12, a carriage HC engages with a spiral groove 5004 of a lead screw 5005, which rotates via driving force transmission gears 5009 to 5011 upon forward/reverse rotation of a drive motor 5013. The carriage HC has a pin (not shown), and is reciprocally moved in directions of arrows a and b in FIG. 12. An integrated ink-jet cartridge IJC which incorporates a printing head IJH and an ink tank IT is mounted on the carriage HC.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of motor 5013.

Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

<Description of a Control Arrangement>

Next, the control structure for performing the printing control of the above apparatus is described.

Figure 13:
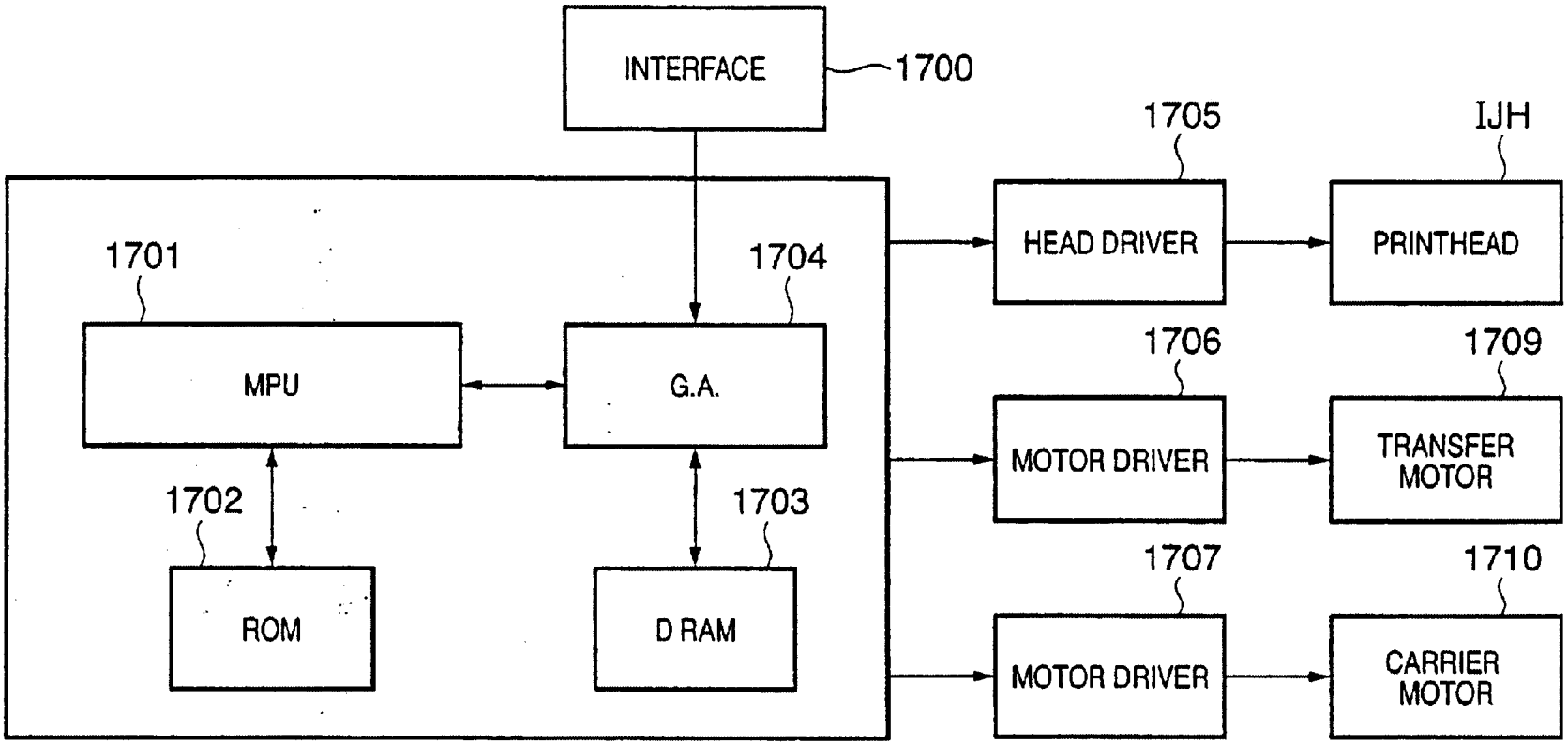
FIG. 13 is a block diagram showing an arrangement of a control circuit of the printing apparatus shown in FIG. 12.

FIG. 13 is a block diagram showing the arrangement of a control circuit of the ink-jet printer. Referring to FIG. 13 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G. A.) for performing supply control of print data to the printing head IJH. The gate array 1704 also performs data transfer control among the interface 1700, the MPU 1701, and the RAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Note that the ink tank IT and the printing head IJH are integrally formed to construct an exchangeable ink cartridge IJC, however, the ink tank IT and the printing head IJH may be separately formed such that when ink is exhausted, only the ink tank IT can be exchanged for new ink tank.

<Description of an Ink Cartridge>

Figure 14:
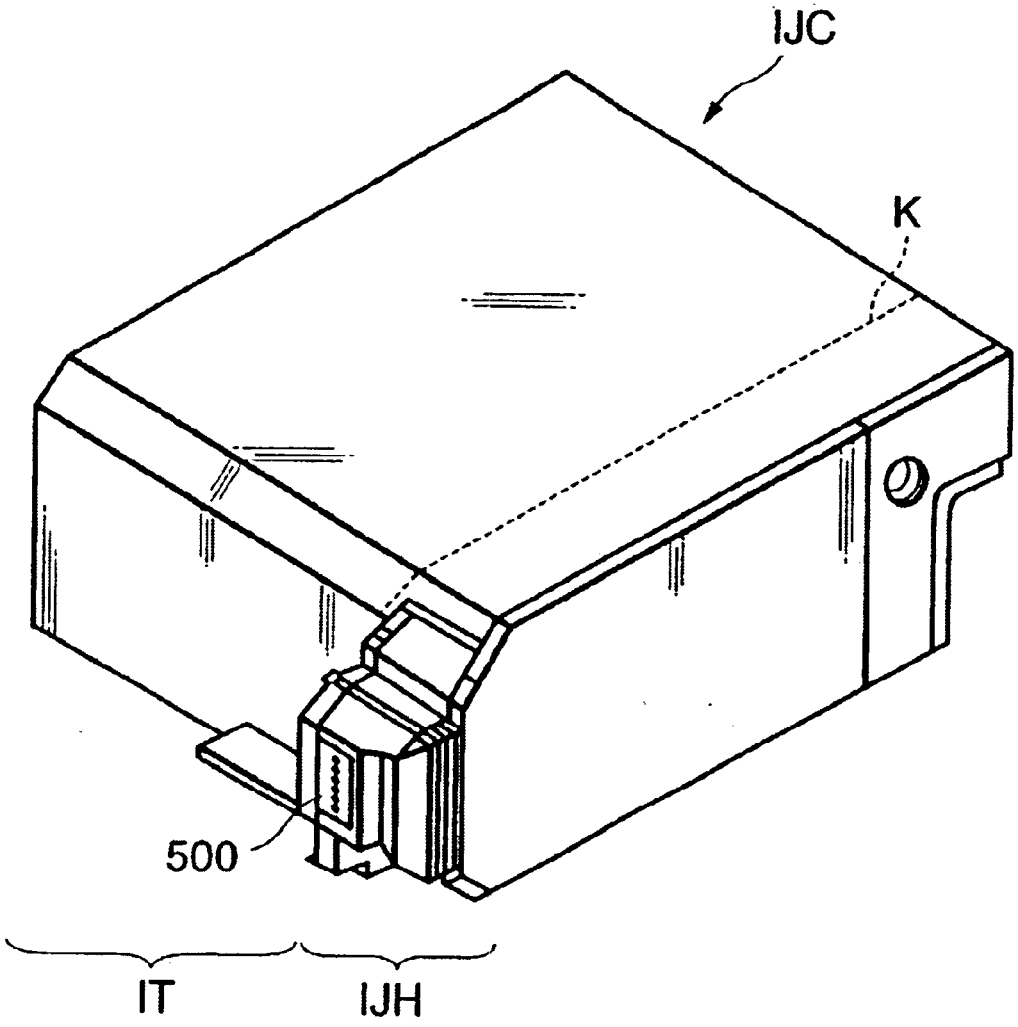
FIG. 14 is a perspective view showing the structure of an ink cartridge IJC where an ink tank and a head can be separated.

FIG. 14 is a perspective view showing the structure of the ink cartridge IJC where the ink tank and the head can be separated. As shown in FIG. 14 in the ink cartridge IJC, the ink tank IT and the printing head IJH can be separated along a line K. The ink cartridge IJC has an electrode (not shown) for receiving an electric signal supplied from the carriage HC (see FIG. 12) side when it is mounted on the carriage HC. By the electric signal, the printing head IJH is driven as above, and discharges ink.

Note that in FIG. 14, numeral 500 denotes an ink-discharge orifice array. Further, the ink tank IT has a fiber or porous ink absorbing body. The ink is held by the ink absorbing body.

A drive circuit for a printhead according to the present invention used in the ink-jet printer set forth above will now be described.

<Structure of Drive Circuit>

Figure 1:
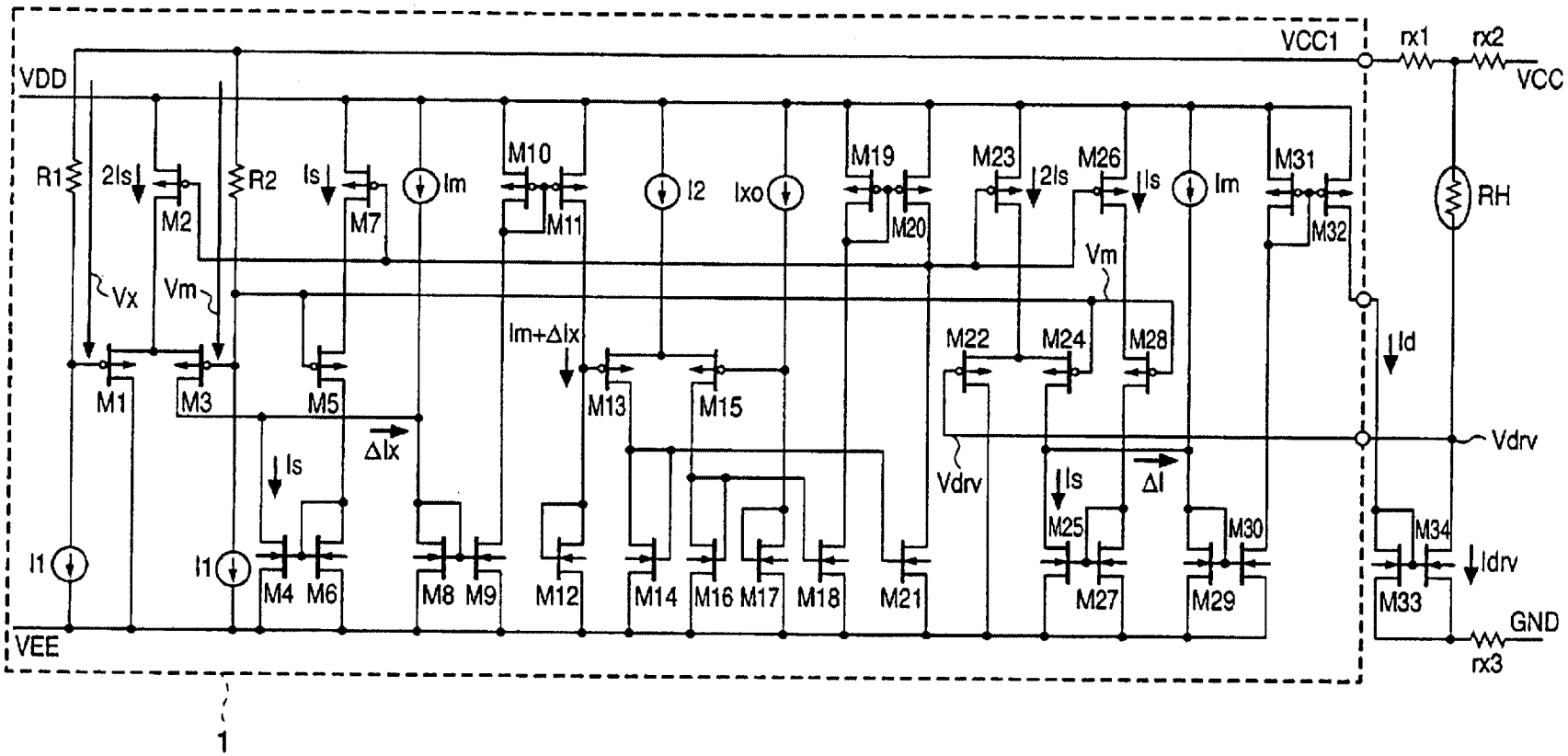
FIG. 1 is a circuit diagram illustrating an embodiment of a drive circuit according to the present invention.

FIG. 1 is a circuit diagram illustrating an embodiment of a printhead drive circuit according to the present invention. Components similar to those shown in FIG. 11 described above in relation to the prior art are designated by like reference characters.

Figure 11:
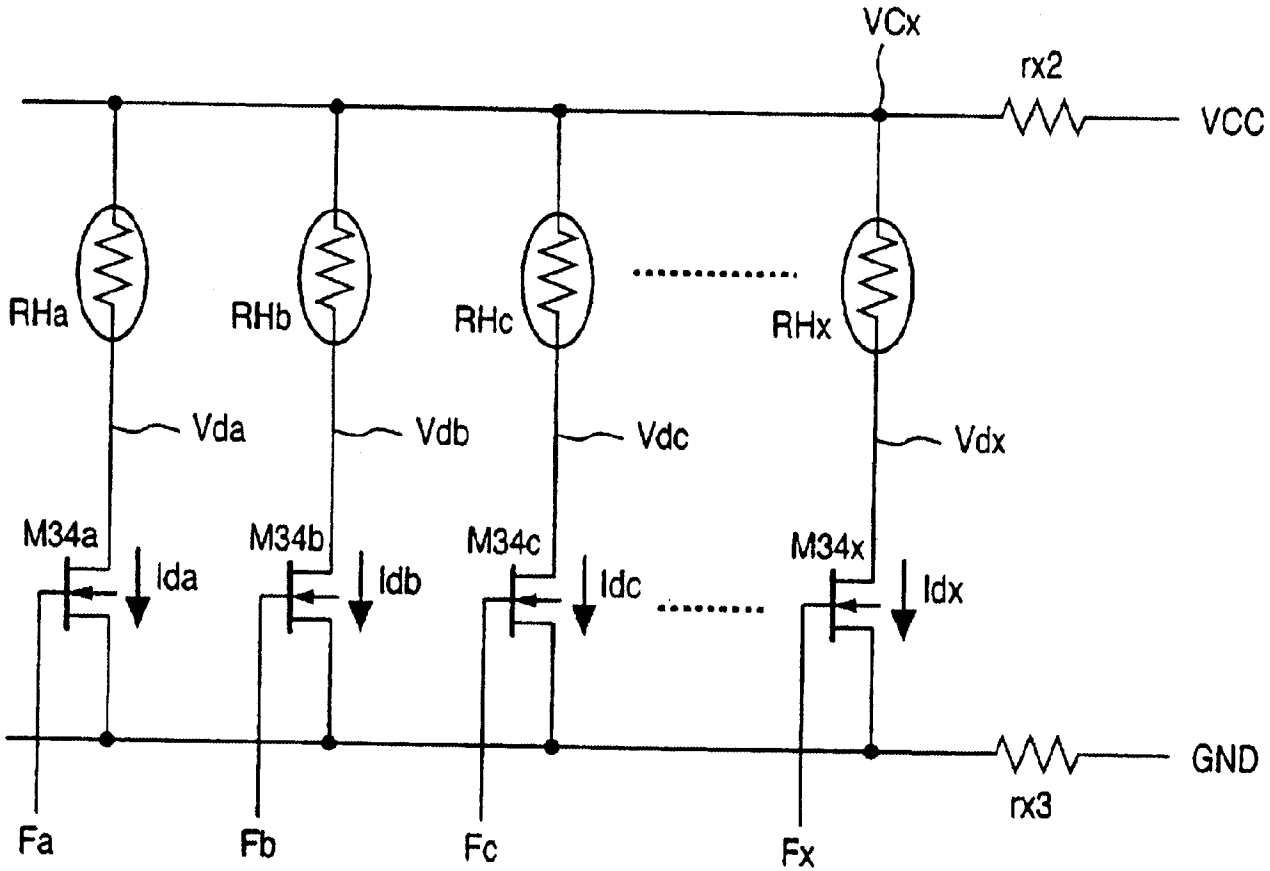
FIG. 11 is a circuit diagram illustrating an example of a drive circuit of a printhead according to the prior art.

In a manner similar to that of the conventional drive circuit shown in FIG. 11, one end of a heater RH constituted by a resistor is connected to a power supply VCC via a power supply wiring resistor rx2. The other end of the heater is connected to the drain of a transistor M34 whose source is connected to the power supply GND. It should be noted that although only one heater RH is illustrated in FIG. 1, a plurality of heaters can of course be connected in parallel in a manner similar to that shown in FIG. 11.

The portion enclosed by the dashed line in FIG. 1 is a power control circuit 1. The power control circuit 1 has resistors R1 and R2 connected to the heater RH via the wiring resistor rx1. A constant current I1 flows into each of these resistors. The resistors R1 and R2 are connected to the gates of transistors M1 and M3, respectively. The power supply VCC for driving the heater also is supplied to the power control circuit 1 via the wiring resistor rx1. In addition, an internal power supply VDD is provided as a second power supply.

The sources of the transistors M1 and M3 are both connected to the drain of a transistor M2 connected to the internal power supply VDD. The drain of the transistor M1 is connected to an internal power supply VEE. The drain of the transistor M3 is connected to the drain of a transistor M4, which has a source connected to the internal power supply VEE, and to a constant current source Im as well as to the drain and gate of a transistor M8 whose source is connected to the internal power supply VEE.

The gate and drain of the transistor M8 are connected to the gate of a transistor M9 whose source is connected to the internal power supply VEE. The drain of the transistor M9 is connected to the drain and gate of a transistor M10 whose source is connected to the internal power supply VDD, and to the gate of a transistor M11 whose source is connected to the internal power supply VDD. Further, the drain of the transistor M11 is connected to the drain and gate of a transistor M12 whose source is connected to the internal power supply VEE, and to the gate of a transistor M13.

The drain of a transistor M7, which has a source connected to the internal power supply VDD and a gate connected to the gate of the transistor M2, is connected to the source of a transistor M5 whose gate is connected to the gate of the transistor M3, and the drain of the transistor M5 is connected to the drain and gate of a transistor M6, which has its source connected to the internal power supply VEE, and to the gate of the transistor M4.

A constant current source Ixo is connected to the drain and gate of a transistor M17, which has its source connected to the internal power supply VEE, and to the gate of a transistor M15. The source of the transistor M13 and the source of the transistor M15 are both connected to a constant current source I2.

The drain of the transistor M15 is connected to the drain and gate of a transistor M16, which has its source connected to the internal power supply VEE, and to the gate of a transistor M18 whose source is connected to the internal power supply VEE. The drain of the transistor M18 is connected to the drain and gate of a transistor M19, and to the gate of a transistor M20 whose source is connected to the internal power supply VDD.

The drain of the transistor M13 is connected to the drain and gate of a transistor M14, which has its source connected to the internal power supply VEE, and to the gate of a transistor M21 whose source is connected to the internal power supply VEE.

The drains of the transistors M21 and M20 are connected to each other and to the node thereof are connected the gates of transistors M2, M7, M23 and M26, the sources of which are connected to the internal power supply VDD. The sources of transistors M22 and M24 are both connected to the drain of the transistor M23, and the gate of the transistor M24 is connected to the gate of transistor M3.

Further, the drain of the transistor M22 is connected to the internal power supply VEE. The drain of the transistor M24 is connected to the drain of a transistor M25, which has its source connected to the internal power supply VEE, to the constant current source Im, as well as to the drain and gate of a transistor M29 whose source is connected to the internal power supply VEE.

The drain of the transistor M26 is connected to the source of a transistor M28 whose gate is connected to the gate of the transistor M3, and the drain of a transistor M28 is connected to the drain and gate of a transistor M27, which has its source connected to the internal power supply VEE, and to the gate of the transistor M25.

The drain and gate of the transistor M29 are connected to the gate of a transistor M30 whose source is connected to the internal power supply VEE, and the drain of the transistor M30 is connected to the drain and gate of a transistor M31, which has its source connected to the internal power supply VDD, and to the gate of a transistor M32 whose source is connected to the internal power supply VDD.

The drain of the transistor M32 is connected to the drain and gate of a transistor M33 whose source is connected to the power supply GND via the wiring resistor rx1, and the gate of the transistor M33 is connected to the gate of a transistor M34 whose source is connected to the source of the transistor M33. The drain of the transistor M34 is connected to the heater RH and to the gate of the transistor M22.

<Operation of Power Control Circuit 1>

The operation of the power control circuit 1 will be described next. In order to simplify the description, it will be assumed that the current driving characteristics of the transistors in the circuit of FIG. 1 are related as follows:

| |
|---|
| M1 = M3 = M5 = M22 = M24 = M28 |
| M4 = M6 = M25 = M27 |
| M8 = M9 = M29 = M30 |
| M10 = M11 = M31 = M32 |
| M2 = 2 × M7 = M23 = 2 × M26 |
| M12 = M17 |
| M13 = M15 |
| M14 = M18 |
| M16 = M21 |
| M19 = M20 |
| M33 = N × M34 |

Further, it will be assumed that the resistance values of the resistors R1 and R2 are in a relative relationship.

Since it is easy to make the value (2×I1) of the current that flows through the wiring resistor rx1 so small as to render the voltage drop across the wiring resistor rx1 negligible, it will be assumed that VCC1=VCC holds. Further, in the integrated circuit, a constant voltage Vbg (approximately 1.26 V) can be generated by a band-gap voltage circuit, which is not shown. A constant current I1=Vbg÷Rx can therefore be generated from this voltage by an internal resistor Rx of the integrated circuit, and stable voltages are obtained as terminal voltages Vm and Vx of the resistors R1 and R2, respectively. This is because the value of the resistor Rx, which is the internal resistance of the integrated circuit, and the values of resistors R1 and R2 exhibit good relative precision. Further, a coefficient voltage of the band-gap voltage Vbg can readily be set by the ratio of the resistance values of resistors Rx, R1 and R2.

An example of a method of readily generating the voltages Vm and Vx is to provide a DAC circuit within the integrated circuit. Further, as for the constant current sources Im and Ixo, highly accurate constant current sources can readily be implemented by connecting a highly precise external resistor to the output (Vbg) of the band-gap voltage circuit, generating a highly precise reference current and producing the coefficient current based upon the size ratio of the transistors.

The current Ix supplied to the transistor M8 in FIG. 1 will be described with reference to FIG. 3, in which only the relevant circuitry has been extracted from FIG. 1. In order to simplify the description, it will be assumed that the transistors M1 and M3 operate in a pentode area represented by Vds>Vgs−Vth, where Vds, Vgs and Vth represent the drain-source voltage, gate-source voltage and transition voltage, respectively, of the transistors M1 and M3.

Figure 3:
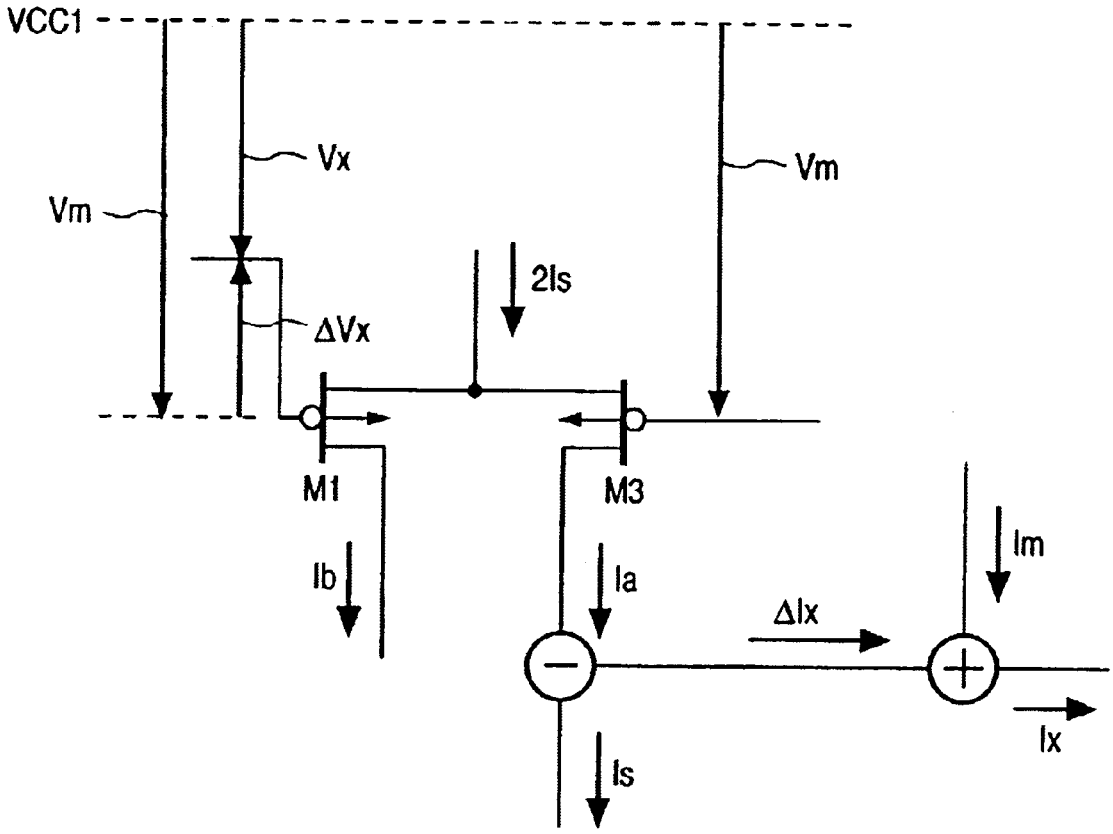
FIG. 3 is a diagram useful in describing the operation of the drive circuit of FIG. 1.

In FIG. 3, the following relationships indicated by Equations (2) and (3) hold with regard to the transistors M1 and M3, respectively:

$$Ia=\beta\times(Vgs1-Vth)^2 \quad (2)$$

$$Ib=\beta\times(Vgs3-Vth)^2 \quad (3)$$

where β represents the current driving coefficient and Vgs1, Vgs3 represent the gate-source voltages of the transistors M1, M3, respectively.

The following equation holds from Equations (2) and (3):

$$\Delta Vx=Vgs3-Vgs1=(1\div\sqrt{\beta})\times(\sqrt{Ia}-\sqrt{Ib}) \quad (4)$$

It should be noted that we have $$Ia=Is+\Delta Ix$$

$$Ib=Is-\Delta Ix$$

and $$\Delta Ix=(Ia-Ib)\div 2$$

Transforming Equation (4) gives the following:

$$\Delta Vx=(2\div\sqrt{\beta})\times\Delta Ix\div(\sqrt{Ia}+\sqrt{Ib})=(2\div\sqrt{\beta})\times\Delta Ix\div[\sqrt{(Is+\Delta Ix)}+\sqrt{(Is-\Delta Ix)}] \quad (5)$$

Let Rm represent the standard resistance value of heater RH, and let Vo represent the terminal voltage produced when power P is consumed by the heater RH whose resistance value is Rm. Assume that the resistance value fluctuates by a factor of m. If we assume that the power P consumed by the heater RH is the same under these conditions, then P will be as follows:

$$P=[\sqrt{m}\times Vo\div(m\times Rm)]\times[\sqrt{m}\times Vm)$$

Therefore, it is required that the terminal voltage Vx and current Ix of the heater RH satisfy the following equations:

$$Vx=\sqrt{m}\times Vm \quad (6)$$

$$Ix=\sqrt{m}\times Vm\div(m\times Rm) \quad (7)$$

Figure 10:
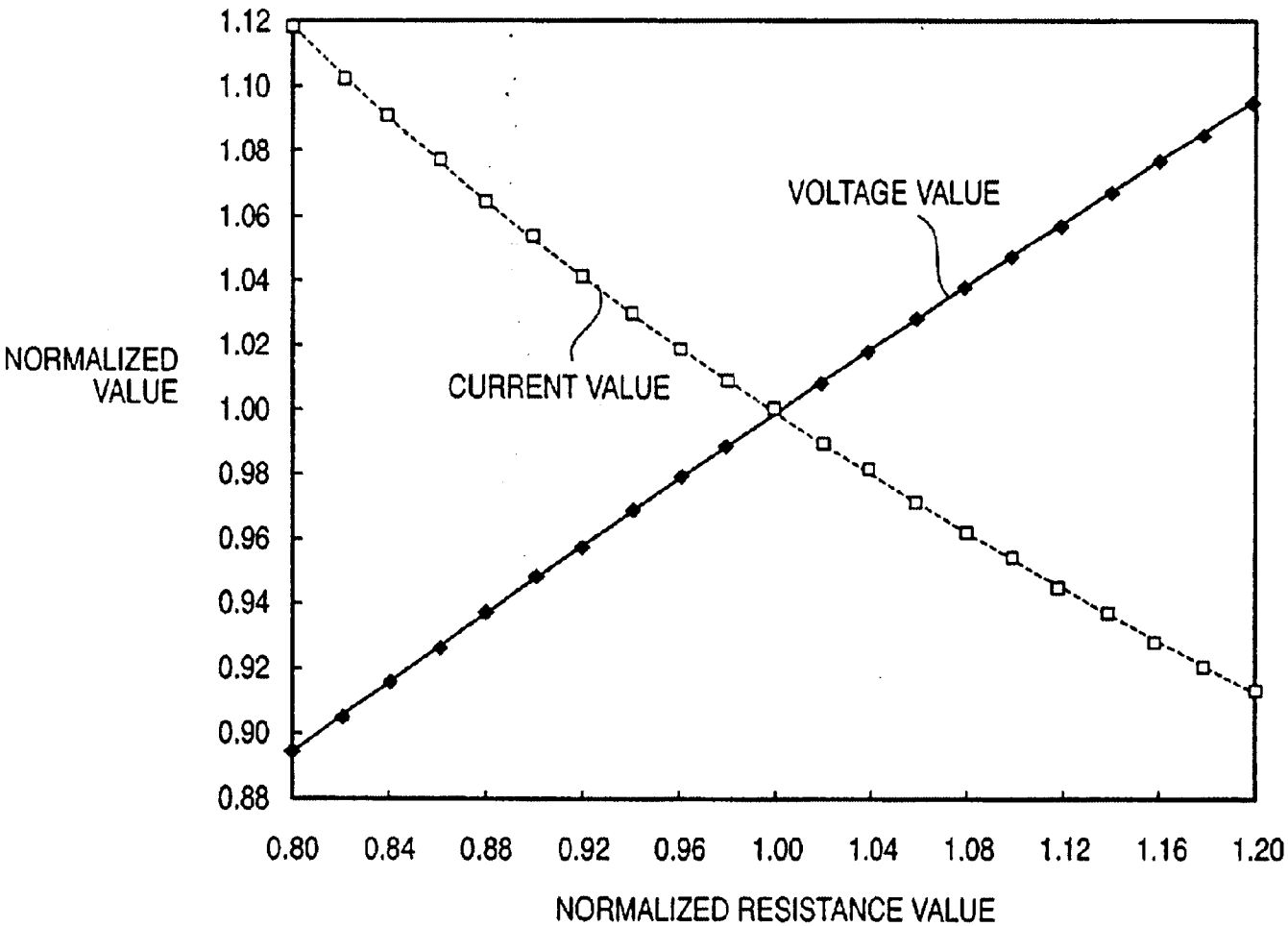
FIG. 10 is a graph illustrating the relationship between voltage and current when a resistance value changes.

FIG. 10 is a graph in which the relationship between the value of terminal voltage Vx and the value of current Ix when the resistance value of the heater RH has varied by about ±20% is represented, with the values of Vm and Im that prevail when the resistance value of the heater RH is the standard resistance value Rm being normalized as "1". Further, the relationship between the normalized terminal voltage Vx and normalized current value Ix is as indicated at b in FIG. 8. Thus, the circuit shown in FIG. 3 operates as a voltage-to-current converting circuit when consumed power is constant.

It should be evident from Equation (5) that the operating characteristic of the voltage-to-current converting circuit shown in FIG. 3 is dependent upon the current driving coefficient β, which fluctuates greatly depending upon the temperatures of the transistors M1, M3 and conditions during the manufacturing process thereof. As a consequence, the characteristic is not stable. The operating conditions are set in the manner described below.

<Operating Conditions>

Let the terminal voltage of resistor R2 be the terminal voltage Vm prevailing when the resistance value of the heater RH is the standard resistance value Rm, and let the terminal voltage Vx of resistor R1 be the value of terminal voltage at a desired power consumption prevailing when the resistance value of the heater RH is 0.8×Rm, i.e., $$Vx=\sqrt{0.8}\times Vm=0.894\times Vm$$

The currents 2Is and Is at this time are set in such a manner that the output current Ix will be $$Ix=(1/\sqrt{0.8})\times Im=1.118\times Im$$

Accordingly, the current driving coefficient β of the transistors M1 and M3 is set in such a manner that the value of control current Is will satisfy the relation Is=Im. In other words, the setting is made in such a manner that the value of error current ΔIx will satisfy the following relation:

$$\Delta Ix=0.118\times Is$$

when the following holds:

$$Vx=0.894\times Vm$$

If this arrangement is adopted, ΔVx can be obtained by successively substituting values from −0.12 to +0.12 into Ix in Equation (5), and it is possible to derive the value of output current Ix=ΔIx+Im with respect to the terminal voltage Vx=Vm−ΔVx. The voltage-current characteristic at this time becomes a characteristic of the kind indicated at a in the graph of FIG. 8. This indicates that there is only a very small difference between this and b, which indicates the relationship between the terminal voltage and current value of the resistor, for obtaining the normalized power ( =1) in conformity with the fluctuation of the heater resistance value. In this case, $2/\sqrt{\beta}=1.76$ holds in Equation (5). In the case of the characteristic indicated at a in FIG. 8, the value of the error current ΔIx is ±12% of the value of the control current Is and varies linearly with a change in the terminal voltage Vx.

A method of setting these operating conditions in the power control circuit 1 of FIG. 1 will be described next.

First, in a manner similar to that described above, the terminal voltage Vs of resistor R1 is set so as to satisfy the following relation:

$$Vx=\sqrt{m}\times Vm=0.894\times Vm$$

The constant current Ixo is set so as to satisfy the following relation:

$$Ixo=1.118\times Im$$

If this is done, the currents 2Is and Is of the transistors M2 and M7 are controlled by the voltage comparison operation performed by the transistors M13, M15 and by the charge pump circuit composed of the transistors M14, M16, M18, M19, M20 and M21, and control is carried out in such a manner that the output current Ix of the transistor M11, i.e., $$Ix=\Delta Ix+Im$$

will become equal to the above-mentioned constant current Ixo.

This operation is assured irrespective of the current driving coefficient β and temperature characteristic of the transistors used. More specifically, the output characteristic of the transistor M11 in FIG. 1 is controlled so as to become the linear characteristic indicated at a in FIG. 8.

Output currents 2Is and Is are similarly generated in the transistors M23 and M26 and are input to a voltage-current converting circuit that includes the transistors M22 and M24 constructed in a manner similar to that of the voltage-current converting circuit that includes the transistor M1 and M3. As a result, the relationship between the current that flows through the heater RH, which is in correlation with the output current of the transistor M32, and the terminal voltage of the heater RH also becomes similar to that indicated at a in FIG. 8.

Figure 8:
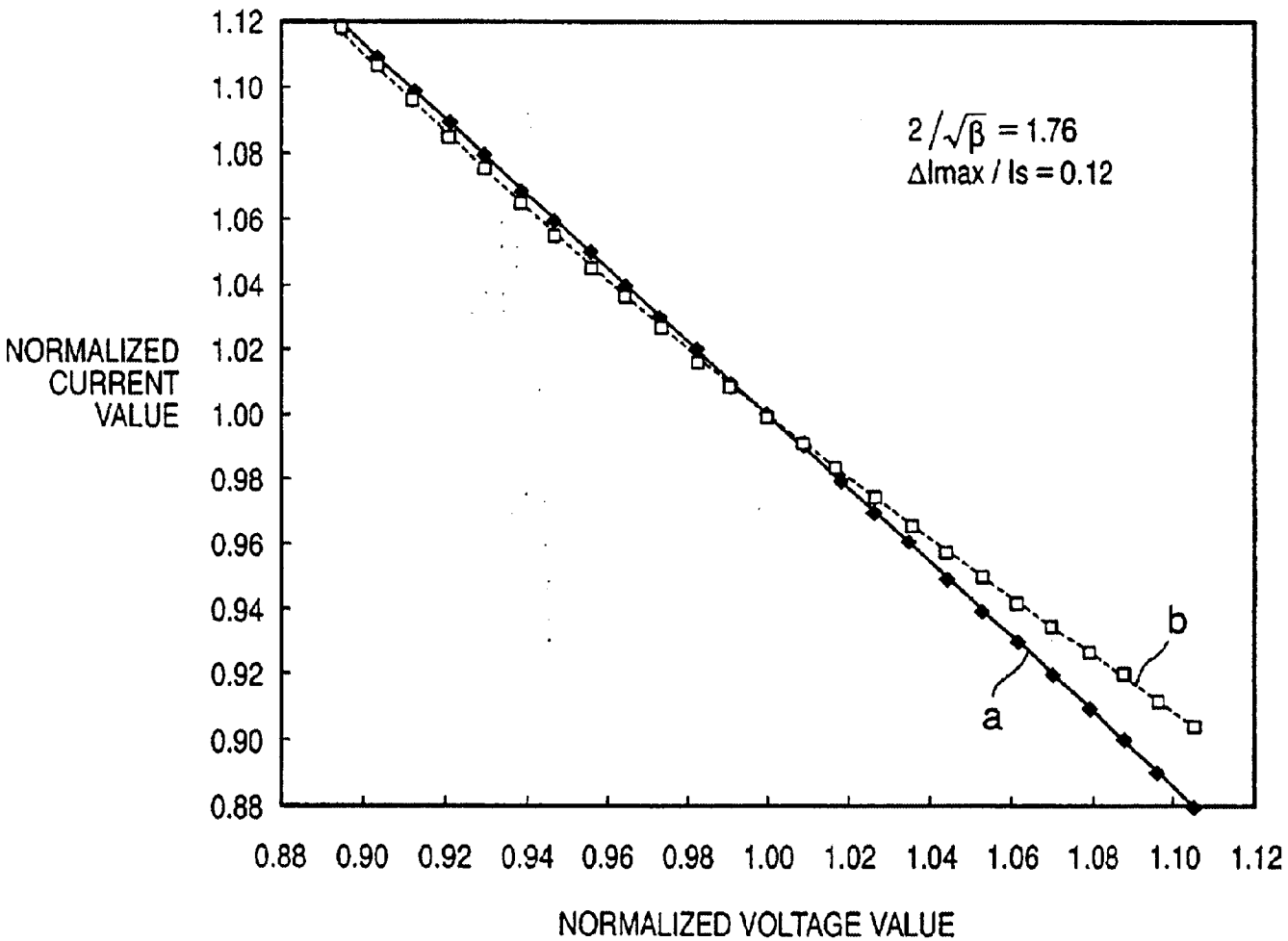
FIG. 8 is a graph illustrating a voltage—current characteristic of the drive circuit shown in FIG. 1.
Figure 9:
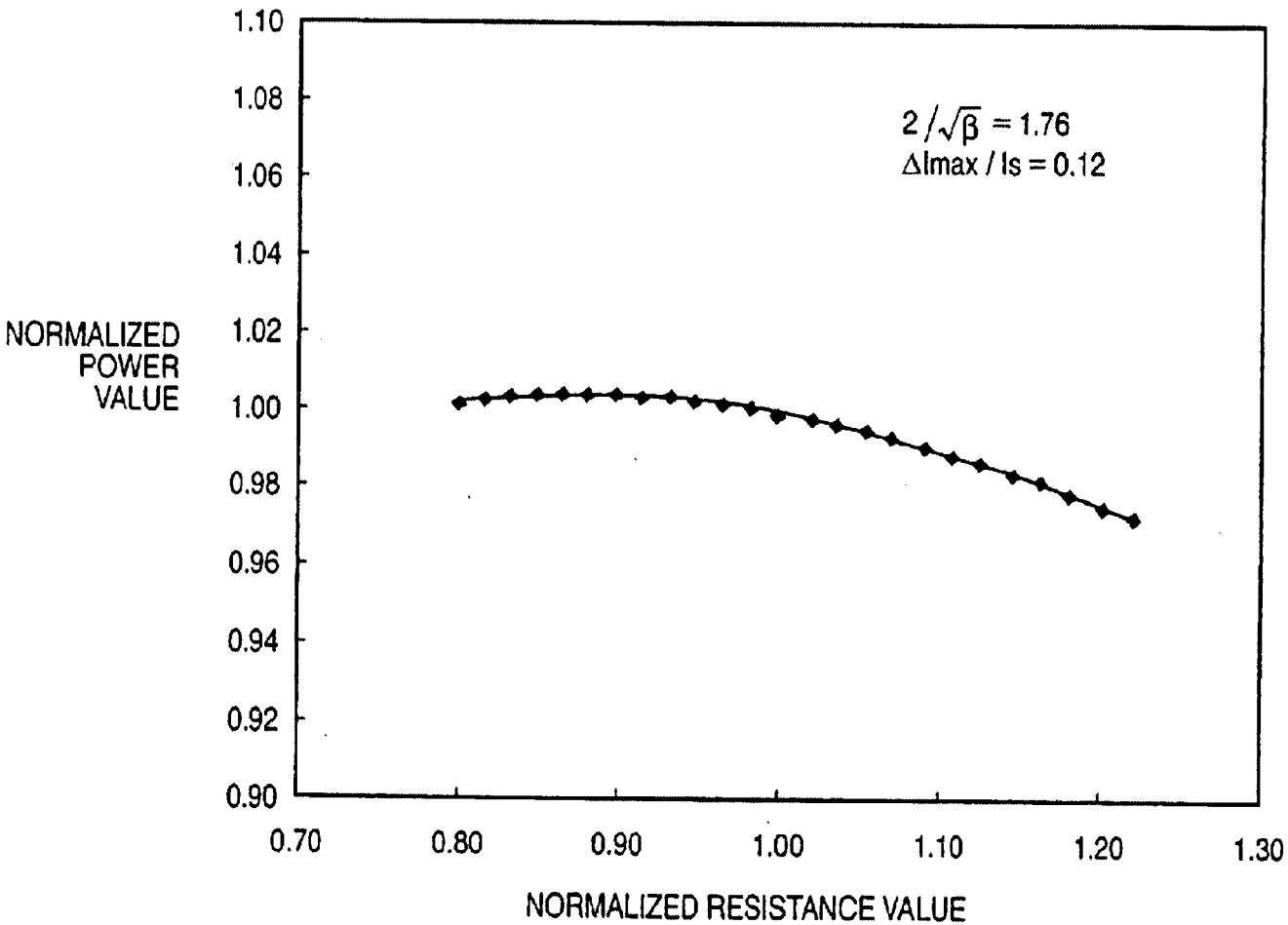
FIG. 9 is a graph illustrating the relationship between a fluctuation in resistance value and power consumed in the drive circuit of FIG. 1.

The voltage-current characteristic indicated at a in FIG. 8 illustrates a characteristic that prevails when the resistance value of the heater RH has fluctuated by ±20%. FIG. 9 is the result of converting this to a graph indicating fluctuation of the power consumed by the heater RH with respect to a fluctuation in resistance value in the drive circuit of FIG. 1.

Though power in the conventional drive circuit fluctuates by 40%, as indicated by Equation (1), described in the description of the prior art, fluctuation of power can be held to about 3% with the drive circuit of this embodiment.

Figure 4:
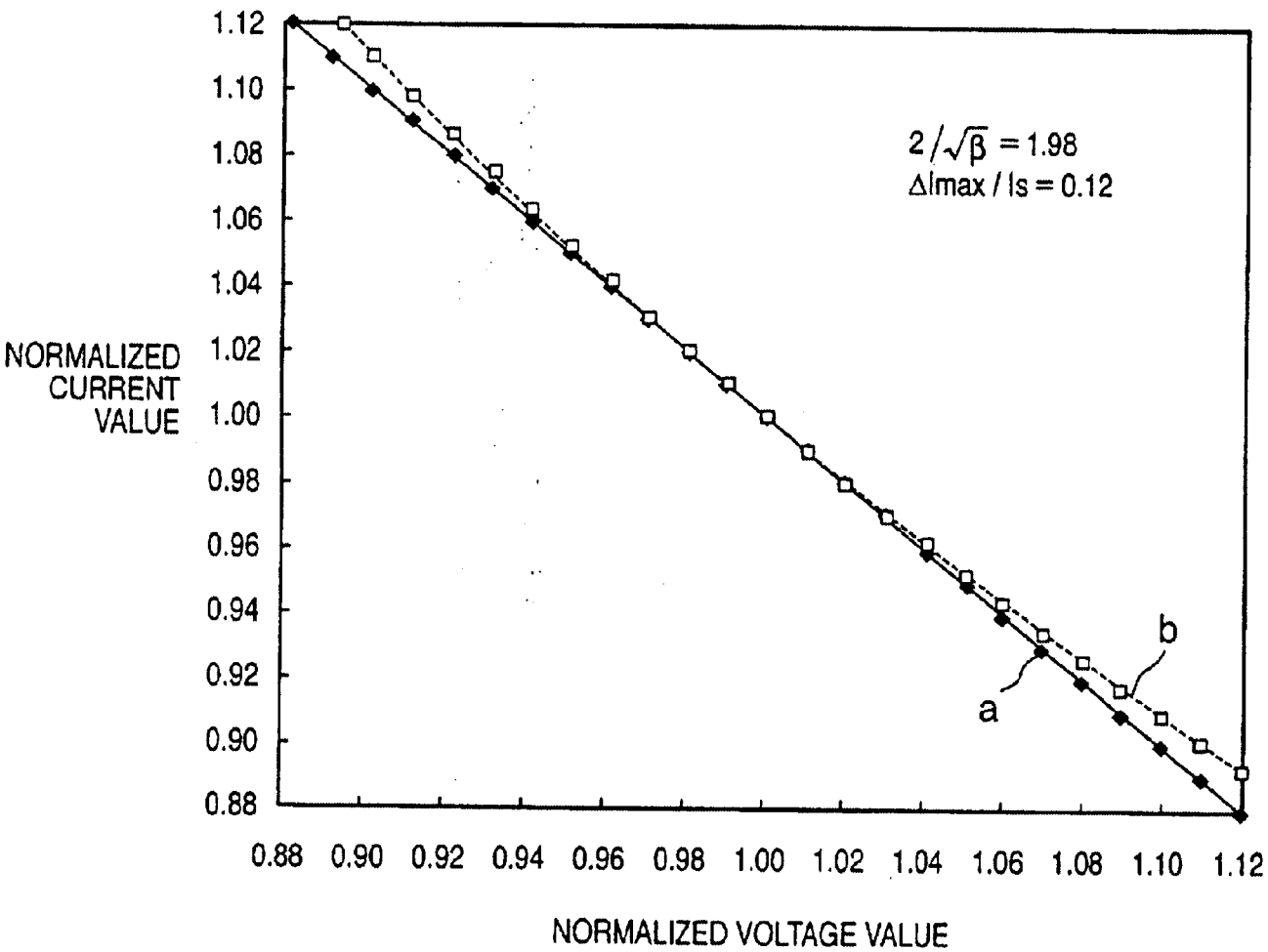
FIG. 4 is a graph illustrating a voltage—current characteristic of the drive circuit shown in FIG. 1.
Figure 5:
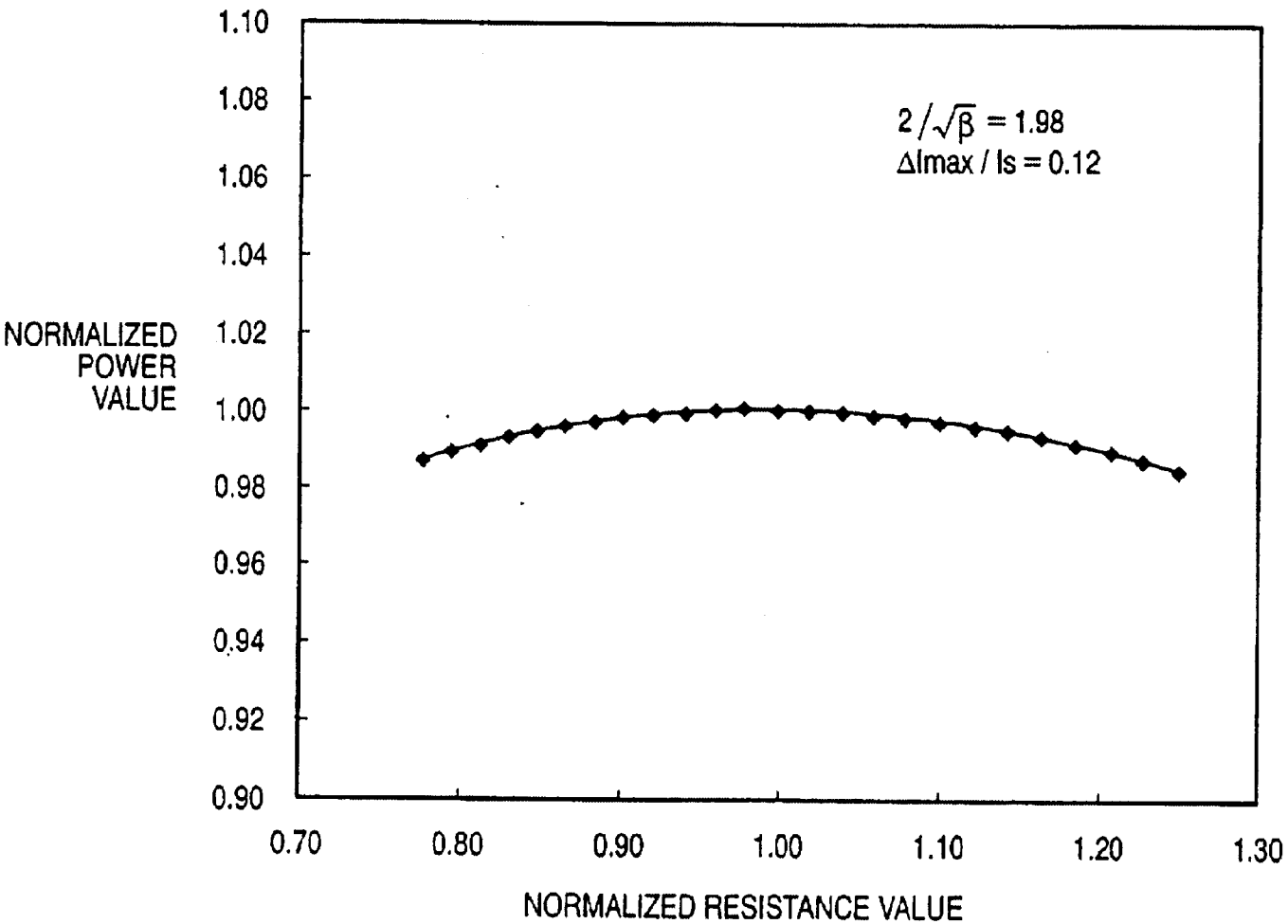
FIG. 5 is a graph illustrating the relationship between a fluctuation in resistance value and power consumed in the drive circuit of FIG. 1.

Further, the output current characteristics of the transistors M11 and M32 can be set so as to make the power fluctuation even smaller. In a specific example, a in the graph of FIG. 4 indicates the relationship between current and voltage in a case where current Ixo=1.105×Im is set in the power control circuit 1 shown in FIG. 1. It should be noted that b indicates the relationship between the resistor terminal voltage and current value for obtaining the normalized power (=1) in conformity with fluctuation of the heater resistance value. In this case, $2/\sqrt{\ }=1.98$ holds. Further, FIG. 5 illustrates fluctuation of consumed power with respect to fluctuation of the resistance value of heater RH in a case where the voltage-current characteristic is as indicated at a in FIG. 4. In this case, fluctuation of consumed power can be held to about 1.5% with respect to a fluctuation of 40% (20%) in the resistance value of the heater RH, as will be understood from FIG. 5.

Thus, the output current characteristic of the transistors M11 and M32 is influenced by the current driving coefficient β of transistors M1, M3, M22 and M24, as will be understood from Equation (5).

How the voltage-current characteristic of the drive circuit of this embodiment varies owing to a change in the value of the current driving coefficient β will be described.

Figure 6:
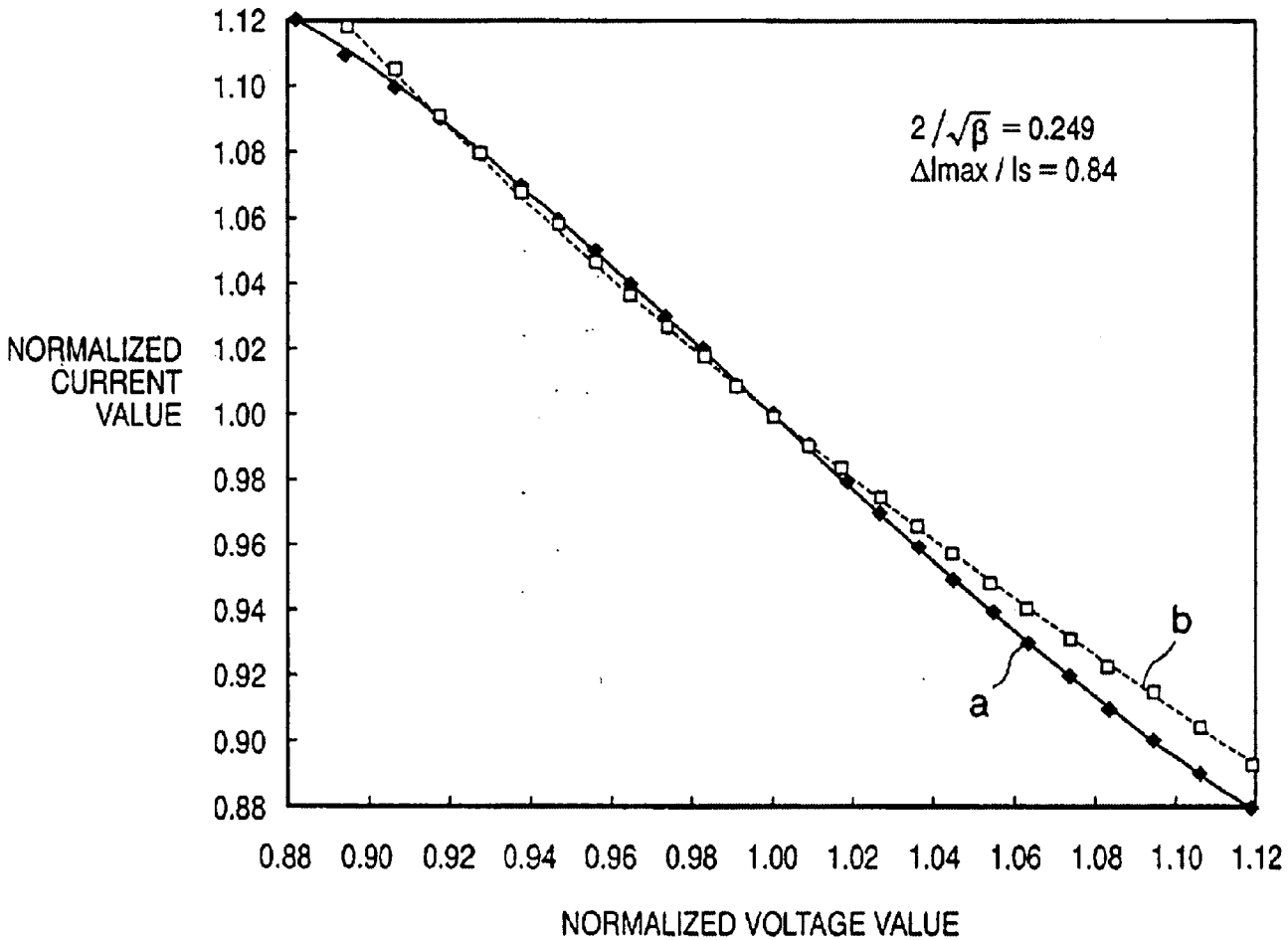
FIG. 6 is a graph illustrating a voltage—current characteristic of the drive circuit shown in FIG. 1.

This will be described taking as an example an instance where it is assumed that the current driving coefficient β takes on a large value and the error current ΔIx varies over a range of ±84% of the control current in accordance with fluctuation of the terminal voltage Vx due to fluctuation of the resistance value. Here the coefficient $2/\sqrt{\ }=0.249$ holds and the relationship between current and voltage becomes as indicated at a in the graph of FIG. 6. It should be noted that b indicates the relationship between the terminal voltage and current value of the resistor for obtaining normalized power (=1) in conformity with fluctuation of the heater resistance value.

In this case, the output current characteristic of the transistor MOS differential circuit starts to present an S-shaped appearance, as illustrated. However, even though the value of the current driving coefficient β is thus made to fluctuate by a fairly large amount, there is no great departure from the relationship [b in FIG. 6] between the terminal voltage and current value of the resistor for obtaining the normalized power (=1) in conformity with the fluctuation in heater resistance value.

Figure 7:
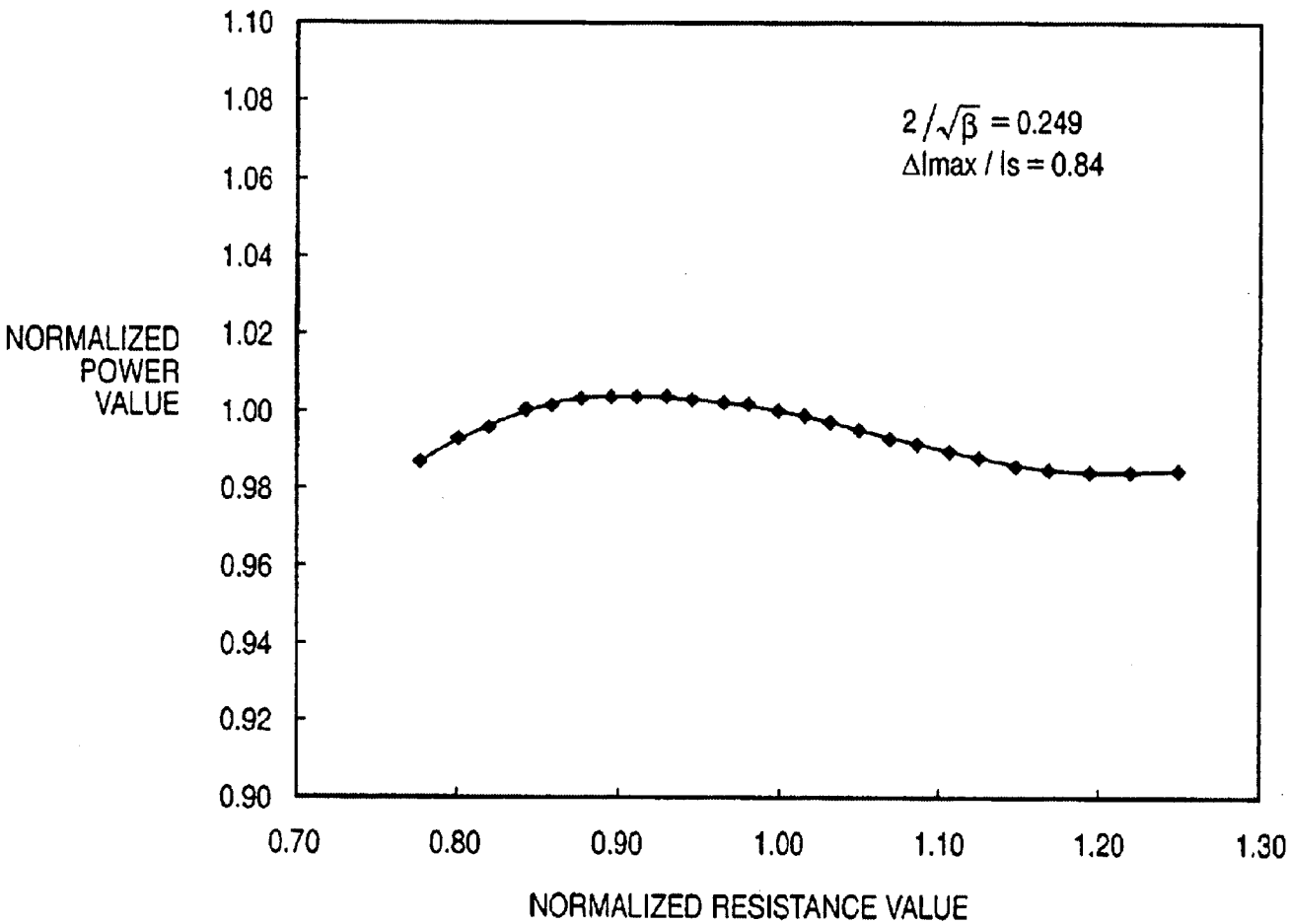
FIG. 7 is a graph illustrating the relationship between a fluctuation in resistance value and power consumed in the drive circuit of FIG. 1.

FIG. 7 is a graph illustrating fluctuation of power with respect to a fluctuation in resistance value at this time. Though the fluctuation in power also similarly indicates an S-shaped curve, the range of fluctuation is very small as before and is held to about 1.5%.

Thus, in accordance with the drive circuit of this embodiment, a suitable voltage-current conversion characteristic is obtained with regard to a broad range of values of the current driving coefficient β of the transistors. This means that a desired characteristic can be achieved even in a case where the power control circuit of FIG. 1 is fabricated (produced) on an element substrate by a semiconductor manufacturing process.

In this embodiment, each transistor is constituted by a MOS transistor. However, it is of course possible to use a bipolar transistor as each transistor.

<Printhead Drive Circuit>

Figure 2:
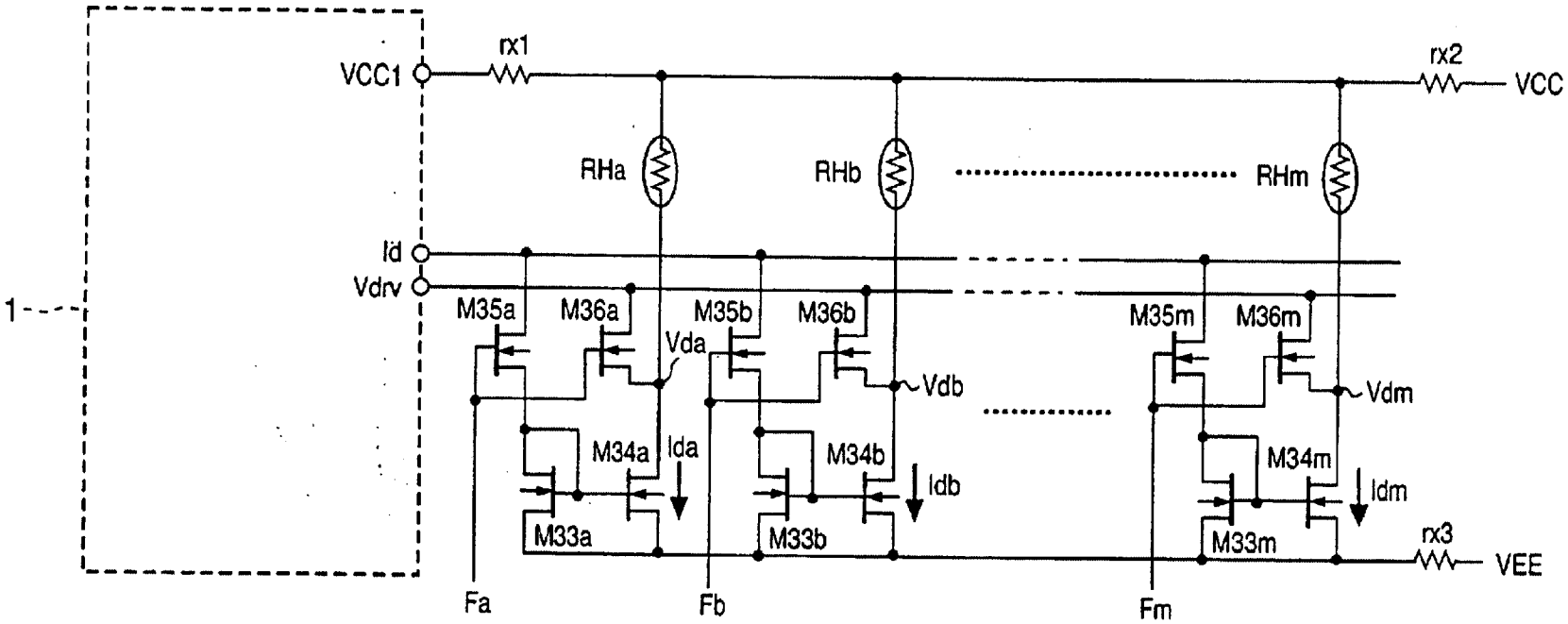
FIG. 2 is a circuit diagram illustrating an example in which the drive circuit of FIG. 1 is used as the drive circuit of a printhead.

FIG. 2 is a circuit diagram illustrating an example in which the power control circuit 1 shown in FIG. 1 is applied to a printhead drive circuit of an ink-jet printer.

In this example, one power control circuit 1 is used for the heaters RHa to RHm within one block in a heater group controlled on by block-by-block basis. The heaters RHa to RHm within the block are ON/OFF controlled by corresponding drive control signals Fa to Fm, respectively.

It should be borne in mind that the heat generating state of the transistor M34 differs depending upon the ON/OFF state of the heater RH and that the current drive characteristic fluctuates as a result. Taking this into consideration, the power control circuit 1 of this embodiment is such that drive of the heaters RHa to RHm is performed by supplying the power control current Id, which is output from the transistor M32, to the current mirror circuit comprising the transistors M33 and M34. If this arrangement is adopted, problems relating to the heat generating state of the transistors M34 and M33 do not arise and there is no voltage fluctuation ascribable to the power supply wiring resistor rx3.

It should be noted that transistors M35*a* to M35*m* and transistors M36*a* to M36*m* in FIG. 2 construct a selection circuit for driving heaters RHa to RHm selected by control signals Fa to Fm, respectively. The operation of the remaining part of the circuit is similar to that described above in connection with FIG. 1.

Thus, by applying the power control circuit 1 according to the present invention to the drive circuit of a printhead, stabilized ink discharge can be achieved with the minimum margin in regard to the power necessary for the ink discharge, power consumption can be suppressed and the lifetime of the printhead can be prolonged.

Furthermore, the present invention solves the problems encountered in the design of the drive circuit of a printhead, namely the variation in the absolute values of the resistance values of resistors, a relative variation in these values, the problem ascribable to the power supply wiring resistors rx2 and rx3, and the problem relating to stabilization of the supply voltage. This makes it possible to reduce the design and structure of the printhead.

[Other Embodiments]

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note further that excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification, or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

The present invention can be applied to a system comprising a plurality of devices (e.g., host computer, interface, reader, printer) or to an apparatus comprising a single device (e.g., copying machine, facsimile machine).

As is apparent, many different embodiments of the present invention can be made without departing from the spirit and scope thereof, so it is to be understood that the invention is not limited to the specific embodiments thereof except as defined in the appended claims.

What is claimed is:

1. A drive circuit comprising:

a resistor having one end thereof connected to a first power supply;

drive control means, which is connected to the other end of said resistor, for controlling drive of said resistor, said drive control means having a control terminal; and a power driving circuit, which is connected to a second power supply, for controlling power consumed by said resistor based upon a value of current supplied to the control terminal of said drive control means;

said power driving circuit including:

a first voltage-to-current converting circuit, to which are input (a) a first voltage value corresponding to voltage across both ends of said resistor prevailing when power consumed by said resistor has attained a predetermined value at such time that the resistance value of said resistor is a set value, (b) a second voltage value corresponding to voltage across both ends of said resistor prevailing when power consumed by said resistor becomes substantially equal to said predetermined value at such time that the resistance value of said resistor fluctuates from the set value, and (c) a current value corresponding to current that flows through said resistor, for controlling an output current value by a control signal that corresponds to a value of voltage across both ends of said resistor; and a second voltage-to-current converting circuit for controlling an output current value based upon the control signal, having a voltage-to-current converting characteristic similar to that of said first voltage-to-current converting circuit, and outputting a current to the control terminal of said drive control means.

2. The circuit according to claim 1, wherein said drive control means includes a current mirror circuit.

3. The circuit according to claim 1, wherein a plurality of said resistors are provided and a plurality of said power driving circuits are provided for every prescribed number of said resistors.

4. The circuit according to claim 1, wherein said circuit is fabricated on an element substrate by a semiconductor manufacturing process.

5. A printhead having a drive circuit comprising: a resistor having one end thereof connected to a first power supply; drive control means, which is connected to the other end of said resistor, for controlling drive of said resistor, said drive control means having a control terminal; and a power driving circuit, which is connected to a second power supply, for controlling power consumed by said resistor based upon a value of current supplied to the control terminal of said drive control means;

said power driving circuit including: a first voltage-to-current converting circuit, to which are input (a) a first voltage value corresponding to voltage across both ends of said resistor prevailing when power consumed by said resistor has attained a predetermined value at such time that the resistance value of said resistor is a set value, (b) a second voltage value corresponding to voltage across both ends of said resistor prevailing when power consumed by said resistor becomes substantially equal to said predetermined value at such time that the resistance value of said resistor fluctuates from the set value, and (c) a current value corresponding to current that flows through said resistor, for controlling an output current value by a control signal that corresponds to a value of voltage across both ends of said resistor; and a second voltage-to-current converting circuit for controlling an output current value based upon the control signal, having a voltage-to-current converting characteristic similar to that of said first voltage-to-current converting circuit, and outputting a current to the control terminal of said drive control means; and said printhead ejecting ink by utilizing thermal energy produced by said resistor.

6. A printing apparatus for printing by a printhead having a drive circuit comprising: a resistor having one end thereof connected to a first power supply; drive control means, which is connected to the other end of said resistor, for controlling drive of said resistor, said drive control means having a control terminal; and a power driving circuit, which is connected to a second power supply, for controlling power consumed by said resistor based upon a value of current supplied to the control terminal of said drive control means;

said power driving circuit including: a first voltage-to-current converting circuit, to which are input (a) a first voltage value corresponding to voltage across both ends of said resistor prevailing when power consumed by said resistor has attained a predetermined value at such time that the resistance value of said resistor is a set value, (b) a second voltage value corresponding to voltage across both ends of said resistor prevailing when power consumed by said resistor becomes substantially equal to said predetermined value at such time that the resistance value of said resistor fluctuates from the set value, and (c) a current value corresponding to current that flows through said resistor, for controlling an output current value by a control signal that corresponds to a value of voltage across both ends of said resistor; and a second voltage-to-current converting circuit for controlling an output current value based upon the control signal, having a voltage-to-current converting characteristic similar to that of said first voltage-to-current converting circuit, and outputting a current to the control terminal of said drive control means; and said printhead ejecting ink by utilizing thermal energy produced by said resistor.

* * * * *